US011772247B2

(12) United States Patent
Ross

(10) Patent No.: US 11,772,247 B2
(45) Date of Patent: Oct. 3, 2023

(54) INDEXABLE RATCHET TOOL

(71) Applicant: Snap-on Incorporated, Kenosha, WI (US)

(72) Inventor: David T. Ross, Beach Park, IL (US)

(73) Assignee: Snap-on Incorporated

( * ) Notice: Subject to any disclaimer, the term of this patent is extended or adjusted under 35 U.S.C. 154(b) by 257 days.

(21) Appl. No.: 16/655,875

(22) Filed: Oct. 17, 2019

(65) Prior Publication Data

US 2021/0114188 A1 Apr. 22, 2021

(51) Int. Cl.

| | |
|---|---|
| ***B25B 23/00*** | (2006.01) |
| ***B25B 13/46*** | (2006.01) |
| ***B25B 13/48*** | (2006.01) |

(52) U.S. Cl.

CPC ..... *B25B 23/0028* (2013.01); *B25B 13/462* (2013.01); *B25B 13/481* (2013.01)

(58) Field of Classification Search

CPC .. B25B 23/0028; B25B 13/462; B25B 13/481
See application file for complete search history.

(56) References Cited

U.S. PATENT DOCUMENTS

| | | | | |
|---|---|---|---|---|
| 4,535,658 | A * | 8/1985 | Molinari | B25B 23/0035 81/177.85 |
| 5,419,221 | A | 5/1995 | Cole | |
| 5,784,934 | A | 7/1998 | Izumisawa | |
| 5,901,620 | A * | 5/1999 | Arnold | B25B 13/463 81/63.2 |
| 6,000,299 | A | 12/1999 | Cole | |
| 6,101,907 | A * | 8/2000 | McGovern | B25B 13/461 81/177.8 |
| 6,216,565 | B1 | 4/2001 | McCann | |
| 6,601,477 | B2 | 8/2003 | Huang | |
| 6,752,048 | B1 | 6/2004 | Chiang | |
| 6,868,758 | B2 | 3/2005 | Chen | |
| 6,928,904 | B2 * | 8/2005 | Hsien | B25B 13/461 81/177.8 |
| 7,104,163 | B2 * | 9/2006 | Hu | B25B 13/06 81/121.1 |
| 7,143,669 | B2 | 12/2006 | Hu | |
| 7,182,000 | B1 | 2/2007 | Dicksen | |
| RE41,296 | E | 5/2010 | Hu | |

(Continued)

FOREIGN PATENT DOCUMENTS

| | | |
|---|---|---|
| AU | 685937 B2 | 1/1998 |
| AU | 765978 B2 | 6/2000 |

(Continued)

OTHER PUBLICATIONS

Examination Report No. 1 for Australian Application No. 2020250243 dated May 20, 2021, 6 pages.

(Continued)

*Primary Examiner* — Hadi Shakeri
(74) *Attorney, Agent, or Firm* — Seyfarth Shaw LLP

(57) ABSTRACT

A tool with a handle indexably retained to a pin. The pin is coupled to a head of the tool. The pin allows an angle between the head and the handle to be adjusted, thereby allowing the tool to be used in hard to reach places. The pin is coupled to the head to limit axial movement without the need of a threaded fastener. The reduction of axial movement allows for smooth, consistent operation of the tool.

13 Claims, 3 Drawing Sheets

(56) References Cited

U.S. PATENT DOCUMENTS

| | | | | |
|---|---|---|---|---|
| 7,712,397 | B2 | 5/2010 | Hu | |
| 7,987,749 | B2 * | 8/2011 | Hsieh | B25G 1/063 81/177.8 |
| 8,646,365 | B2 | 2/2014 | Hsieh | |
| 10,226,861 | B2 * | 3/2019 | Lee | B25B 13/461 |
| 2003/0126957 | A1 | 7/2003 | Huang | |
| 2005/0016332 | A1 | 1/2005 | Hu | |
| 2006/0288825 | A1 | 12/2006 | Hu | |
| 2007/0022847 | A1 | 2/2007 | Chen | |
| 2010/0101376 | A1 | 4/2010 | Chen | |
| 2017/0210000 | A1 | 7/2017 | Lee | |

FOREIGN PATENT DOCUMENTS

| | | | |
|---|---|---|---|
| CN | 1280531 | A | 1/2001 |
| CN | 1317394 | A | 10/2001 |
| CN | 203357339 | U | 12/2013 |
| EP | 1004403 | A2 | 5/2000 |
| GB | 2577800 | A | 4/2020 |
| GN | 1321780 | C | 6/2007 |
| JP | 2001121435 | A | 5/2001 |
| TW | 542053 | | 7/2003 |
| TW | 200413140 | A | 8/2004 |
| TW | I253373 | | 4/2006 |
| TW | 201226119 | A | 7/2012 |
| TW | 201236821 | A1 | 9/2012 |
| TW | 201249604 | A | 12/2012 |
| TW | M476673 | | 4/2014 |

OTHER PUBLICATIONS

Combined Search and Examination Report for Application No. GB2016015.6 dated Mar. 17, 2021, 7 pages.

Chinese Office Action for corresponding Application No. 11020787180 dated Aug. 16, 2021, 3 pages.

Chinese Office Action for corresponding Application No. 202011112710.5 dated Mar. 25, 2022, 10 pages.

Examination Report No. 2 for corresponding Application No. 2020250243 dated May 5, 2022, 3 pages.

Examination Report No. 3 for corresponding Application No. 2020250243 dated May 19, 2022, 3 pages.

Chinese Office Action for corresponding Application No. 2020111127105 dated Dec. 1, 2022, 7 pages.

* cited by examiner

INDEXABLE RATCHET TOOL

TECHNICAL FIELD OF THE INVENTION

The present invention relates generally to hand tools. More particularly, the present invention relates to indexable torque application tools, such as ratchet wrenches.

BACKGROUND OF THE INVENTION

Torque application tools are found in many different forms. For example, ratchet wrenches selectively rotate in either of first and second rotational directions to apply desired torque to a work piece, such as a threaded fastener. The tool rotates in a first rotational direction to apply torque to the work piece in that direction, and then rotates or ratchets in a second rotational direction without applying torque, thus allowing the tool to return to a desired location. The tool can then be rotated in the first rotational direction again to continue applying torque to the work piece, and the process is repeated until the desired amount of torque is applied. Typically, the torque applying and ratcheting rotational directions of the ratchet tool are selectable by a user. Therefore, a user can selectively apply torque in either of clockwise or counterclockwise directions, while respectively ratcheting in the counterclockwise or clockwise directions.

Ratchet tools are often used in hard to reach places or areas, and are often obstructed by obstacles. In these instances, indexable ratchet tools with a pivoting joint between a head and a handle of the tool, such as an indexable head ratchet wrench, can be used to engage and apply torque to a work piece. The pivoting joint allows the ratchet head to be selectively locked in one of multiple fixed positions relative to the handle, thus modifying the angular relationship between head and handle. The pivoting joint can include a pin with a splined portion. Current solutions indexably retain the handle to the head using a pin, wherein the pin is coupled to the head using a threaded fastener, such as a screw. The splines of the pin matingly engage with corresponding splines in the head and the handle to limit rotational movement relative to each other. However, this solution requires a drilling and tapping operation to be performed on the pin. Moreover, this operation, as well as the fastener, add to the cost of manufacturing indexable ratchet tools and introduces a point of failure for the tool.

SUMMARY OF THE INVENTION

The present invention relates broadly to an indexable torque application tool, such as a tool with a head and a head having a ratcheting mechanism. The head and handle of the tool are adapted to be rotated relative to one another and selectively locked at one of multiple angles, thereby allowing angular adjustability between the handle and head. A pin having splines is inserted into a splined aperture of the head. A retaining member is adapted to engage first and second grooves respectively disposed in the pin and the head to prevent axial movement of the pin in the splined aperture. The splines prevent rotational movement between the pin and head. Therefore, the splines and the retaining member cooperatively couple the pin to the head.

In an embodiment, the present invention broadly comprises a tool having a handle, a head, and a pin with circumferentially disposed splines. The handle includes a handle splined aperture disposed proximate to an end of the handle. The head includes opposing first and second ends, a drive portion disposed proximate to the first end, and a head splined aperture disposed proximate to the second end and including a first annular groove adapted to engage with a retaining portion. The pin is adapted to be axially moved relative to the handle between first and second positions, and includes a splined portion adapted to matingly engage with the handle splined and head splined apertures. The splined portion includes a second annular groove adapted to engage with the retaining member. The retaining member restricts axial movement of the pin relative to the head when engaged with the first and second annular grooves. The pin includes a smooth portion and a splined portion, wherein the smooth portion has an outer diameter that is less than the splined portion. Therefore, when the splined portion of the pin matingly engages the handle splined aperture, the angular relation of the head and handle is retained. When the pin is axially moved so that the smooth portion is aligned within the handle splined aperture, the handle can be rotated relative to the head.

In another embodiment, the present invention broadly comprises a connecting pin adapted to indexably retain a handle to a head of a tool. The connecting pin includes a smooth portion and a splined portion. The splined portion includes a first annular groove that substantially aligns with a second annular groove disposed an aperture of the head of the tool, wherein a retaining member cooperatively engages the first and second annular groves to restrict axial movement of the pin relative to the head. The connecting pin also includes a radially extending shoulder portion disposed proximal to the smooth portion, and is adapted to retain the handle on the connecting pin. The connecting pin is adapted to move axially with respect to the handle between first and second position. The splined portion of the connecting pin is adapted to matingly engage a handle splined aperture, thereby retaining angular relation of the head and handle. When the pin is axially moved so that the smooth portion is aligned within the handle splined aperture, the handle can be rotated relative to the head.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
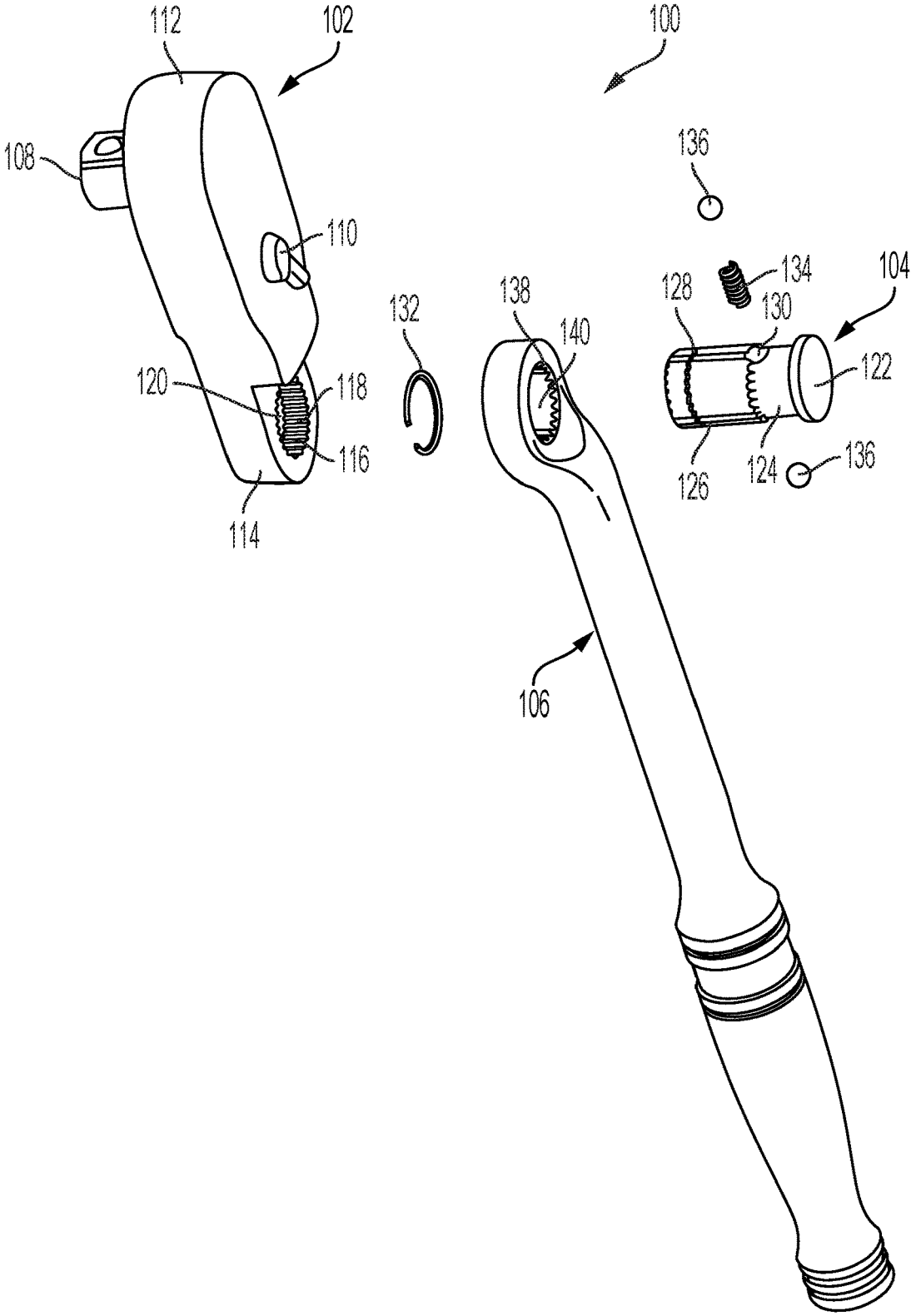
FIG. 1 is a perspective, disassembled view of an embodiment of a tool of the present invention.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly comprises a tool having a head coupled to a pin and an indexable handle. The handle is adapted to be indexably retained on the pin. The head includes a splined aperture with a groove, and the pin also includes a groove, wherein a retaining member is adapted to engage the grooves to restrict axial movement of the pin relative to the head. The pin includes a splined portion that engages with corresponding splines in the head splined aperture to restrict rotational movement of the head relative to the pin. The pin can therefore be coupled to the head of the tool by the retaining member and the splines on the pin and the head aperture without a threaded fastener.

Figure 2:
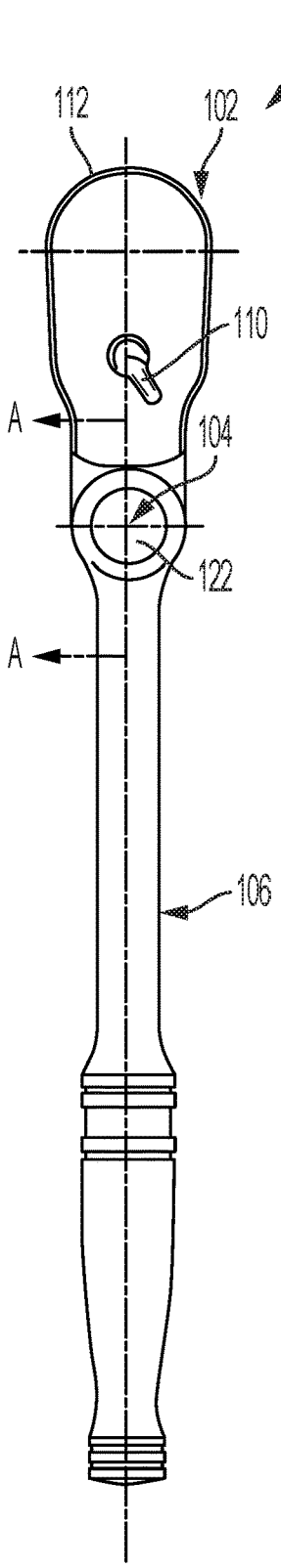
FIG. 2 is a top plan, assembled view of the tool of FIG. 1 in a locked state.
Figure 3:
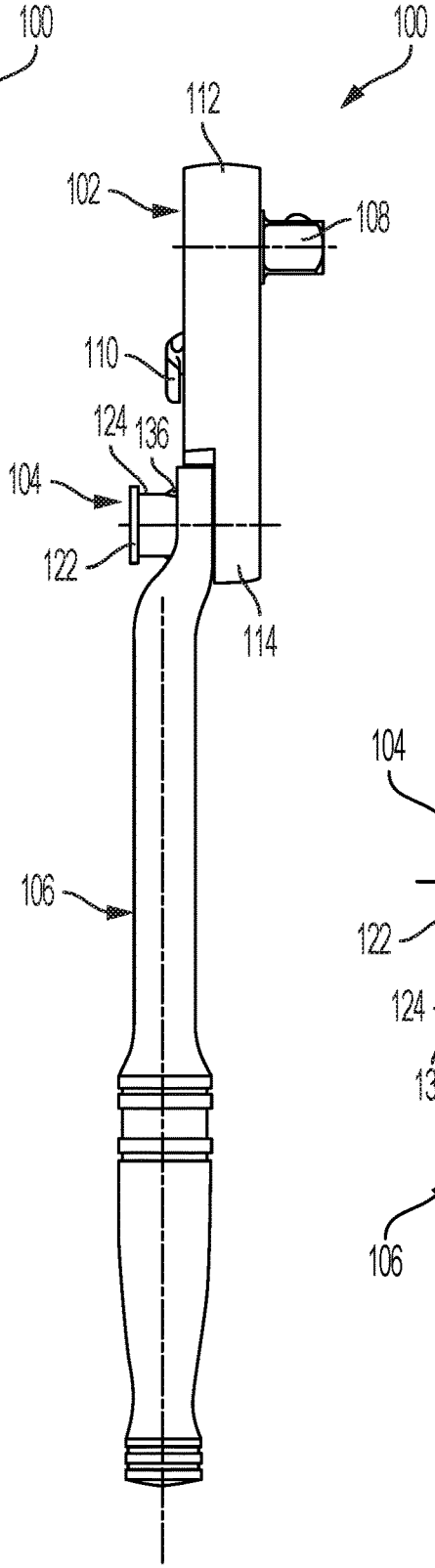
FIG. 3 is a side plan, assembled view of the tool of FIG. 1 in a locked state.
Figure 4:
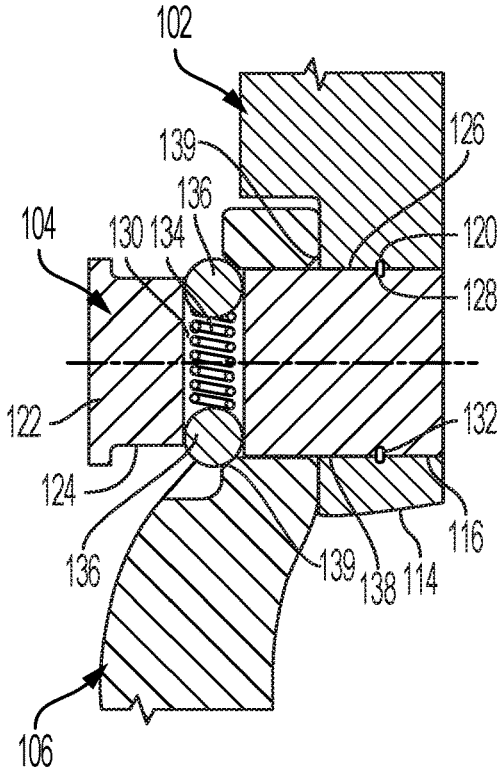
FIG. 4 is section view of the tool of FIG. 1 in a locked state taken along line A-A of FIG. 2.
Figure 5:
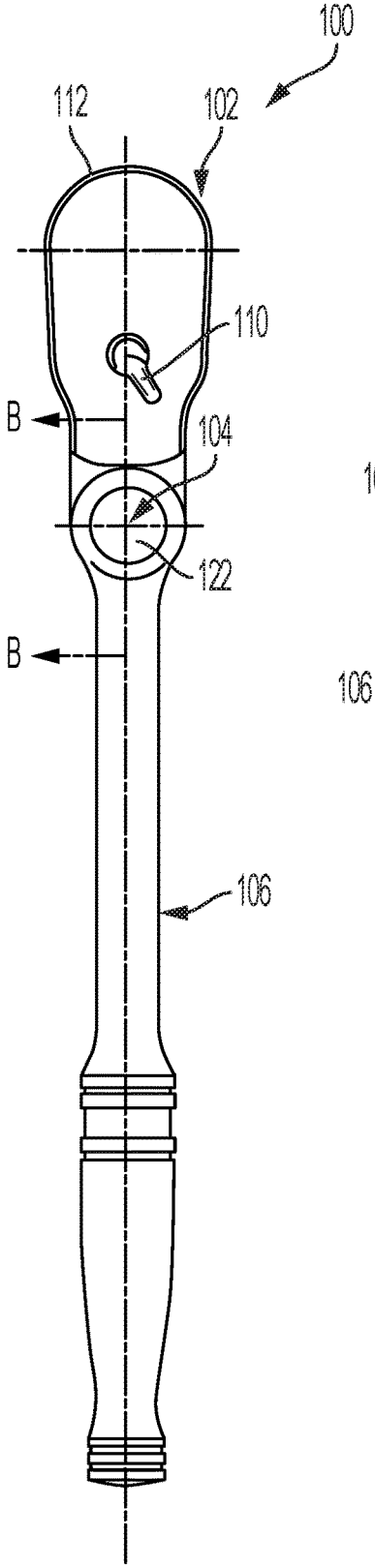
FIG. 5 is a top plan, assembled view of the tool of FIG. 1 in an unlocked state.
Figure 6:
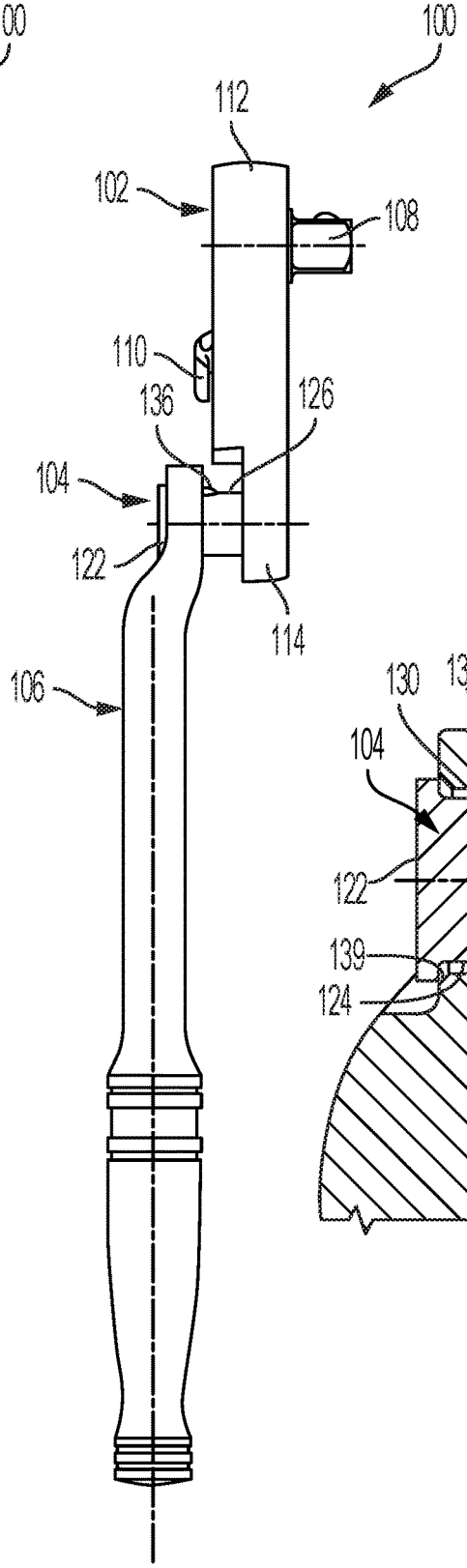
FIG. 6 is a side plan, assembled view of the tool of FIG. 1 in an unlocked state.
Figure 7:
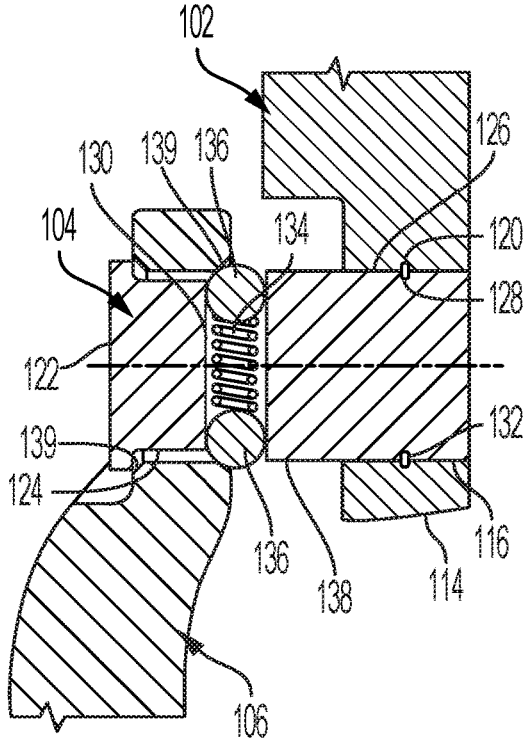
FIG. 7 is section view of the tool of FIG. 1 in an unlocked state taken along line B-B of FIG. 5.

Referring to FIGS. 1 through 7, a tool 100, such as a ratchet tool, includes a head 102, a pin 104, and a handle 106. The head 102 can be provided with a ratchet mechanism that a drive portion 108, a reversing lever 110, and first 112 and second 114 opposing ends, as well-known in the art. The drive portion 108 can include a drive lug disposed proximate a first end 112 of the head 102 and adapted to engage a socket (not shown), as well-known. In another embodiment, the drive portion 108 can include an interchangeable bit (e.g., screw bit, Torx bit) or other means of connecting to a bit or socket. In another embodiment, the head 102 can include a working portion (e.g., a hexagonally shaped cavity) disposed proximate the first end 112 that is adapted to directly engage a work piece, such as, for example, a bolt head or nut, and transfer torque to the work piece without a socket or bit. A reversing lever 110 can be positioned to allow selective clockwise or counterclockwise torque application by a user, as well known in the art.

In an embodiment, the head 102 includes an aperture 116 (also referred to as a head splined aperture) disposed proximate to the second end 114 of the head 102. The aperture 116 includes circumferentially disposed splines 118 and a circumferentially disposed annular groove 120 disposed on an inner surface of the aperture 116. The aperture 116 is adapted to receive a pin 104 and be coupled thereto, as described below.

In an embodiment, the pin 104 includes a mushroomed or radially extending shoulder portion 122, a smooth portion 124, a splined portion 126, a circumferential groove 128, and a bore 130 that can extend through, or partially through, the pin 104 in a radial direction. The radially extending shoulder portion 122 may also be referred to as a head or flange portion, and has a diameter that is larger than the outer diameter of aperture 138. The radially extending shoulder portion 122 is adapted to abut the outer rim of aperture 138, thereby preventing the pin 104 from being inserted or depressed entirely through the aperture 116 of the head 102 and the aperture 138 of the handle 106.

In an embodiment, the smooth portion 124 and splined portion 126 may have a diameter smaller than the radially extending shoulder portion 122; and the smooth portion 124 may have a diameter smaller than the splined portion 126. The splined portion 126 may also correspond to and cooperatively engage splines 118 to restrict rotation of the pin 104 relative to the head 102.

When assembled, the annular groove 128 is adapted to be aligned with the annular groove 120 of the head 102, when the pin 104 is inserted into the aperture 116. A retaining member 132 is adapted to engage the grooves 120 and 138. Accordingly, the retaining member 132 is adapted to restrict axial movement of the pin 104 relative to the head 102. In an embodiment, the retaining member 132 can be a fastener, such as a retaining-ring or snap-ring. Accordingly, the retaining member 132 and cooperative engagement of the splines 118 in the aperture 116 and splines on the splined portion 126 couple the pin 104 to the head 102.

In an embodiment, a biasing member 134, such as, for example, a spring, and two detent balls 136 are disposed in the bore 130. In another embodiment, only one detent ball is disposed in the bore 130 of pin 104. In this embodiment, the bore 130 extends only partially through the pin 104 in a radial direction. The biasing member 134 is adapted to apply a bias force to the detent balls 136 in an outwardly, radial direction of the pin 104, such that the detent balls 136 protrude from an outer surface of the pin 104. The detent balls 136 cooperatively detain the pin 104 relative to the handle 106 in one of either first and second positions, as described below. Moreover, the detent balls 136 may provide a tactile indication to a user when either one of the first and second positions is obtained.

The handle 106 includes an aperture 138 (also referred to as a handle splined aperture) disposed proximate to an end of the handle 106. The aperture 138 can have chamfers 139. The chamfers 139, along with an appropriate bias force exerted by the biasing member 134 on the detent balls 136, assist in allowing axial movement of the pin 104 between the first and second positions relative to the handle 106. The aperture 138 includes splines 140 disposed circumferentially around an inner surface of the aperture 138. The splines 140 are adapted to cooperatively engage with the splined portion 126 of the pin 104. The pin 104 is slidably disposed in the aperture 138 such that the pin 104 can be axially moved between the first and second positions relative to the handle 106. The shoulder portion 122 of the pin 104 is adapted to prevent the handle 106 and the pin 104 from becoming disengaged, as described above. For example, the shoulder portion 122 has a diameter greater than a diameter of the aperture 138, and prevents the handle 106 from sliding off of the pin 104.

During assembly, the aperture 138 of the handle 106 and the aperture 116 of the head 102 are axially aligned with one another. The splined portion 126 of the pin 104 is then inserted into both the aperture 138 of the handle 106 and the aperture 116 of the head 102. The retaining member 132 engages both the annular groove 128 of the pin 104 and the annular groove 120 of the head 102. This couples the pin 104 to the head 102, with the handle 106 disposed between the head 102 and end portion 122 of the pin 104. During use, the pin 104 is adapted to be moved axially between the first and second positions relative to the handle 106. As described above, the shoulder portion 122 can have a diameter that is greater than the diameter of the aperture 138 of the handle 106, thereby preventing the handle 106 from sliding off the pin 104 in an axial direction. Accordingly, the pin 104 is coupled to the head 102, and the handle 106 is indexably retained to the pin 104.

When the pin 104 is disposed in the first position (also referred to as an unlocked position), the aperture 138 of the handle 106 is disposed about the smooth portion 124 of the pin 104 (proximal to the end portion 122). The diameter of the smooth portion 124 is less than the inside diameter of the aperture 138. Accordingly, when the tool 100 is in an unlocked state, the handle 106 can rotate relative to the pin 104 and the head 102 to obtain a desired angular relationship between the handle 106 and head 102. In other words, an angle between a longitudinal axis of the handle 106 and a longitudinal axis of the head 102 can be changed by rotating the handle 106 relative to the head 102 about the connecting pin 104 to a desired angle. This angular adjustment of the handle 106 relative to the head 102 allows the tool 100 to apply torque to a work piece, such as a nut or bolt, where an obstruction or limited space, such as, for example in an engine compartment, prevents appropriate use of a conventional ratchet tool.

When the handle 106 is rotated to a desired angle relative to the head 102, the pin 104 can be moved in an axial direction from the first position (unlocked position) to the second position (also referred to as a locked position). In the second position, the aperture 138 of the handle 106 is disposed about the splined portion 126 of the pin 104, thereby selectively retaining the angular relation of the handle 106 relative to the pin 104 and the head 102. Accordingly, the handle 106 is in a locked state and is adapted to drive the drive portion 108 in a conventional manner at the desired angle between the handle 106 and the head 102.

While the splined portion 126 of the pin 104 and the complementary splines 140 of the aperture 138 disposed in the handle 106 provide an angular adjustment means between the handle 106 and the head 102, it is to be understood that the invention is not limited to splined cross sections. For example, any polygonal cross-section could be used to perform the angular adjustment function.

Therefore, a tool 100, such as an indexable ratchet tool, having a means for adjusting the angle between the head 102 and the handle 106 is provided. The invention is useful in many situations in which an obstruction and/or limited space would prevent use of a conventional ratchet tool. In addition, the invention provides a pin 104 that can be coupled to the head 102 without a threaded fastener.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A tool comprising:

a handle including a handle splined aperture disposed proximate to an end of the handle;

a head including opposing first and second head ends, a drive portion disposed proximate to the first head end, a head splined aperture disposed proximate to the second head end, and a first annular groove extending around the head splined aperture and through splines of the head splined aperture;

a pin axially movable relative to the handle between first and second positions, and including a splined portion having first and second ends, a smooth portion disposed proximate to the second end, and a second annular groove in the splined portion disposed between the first and second ends, wherein the splined portion is meshingly engaged with the head splined aperture proximate to the first end and the second annular groove is aligned with the first annular groove, and the splined portion is adapted to meshingly engage the handle splined aperture proximate to the second end when the pin is disposed in the second position; and a retaining member engaging the first and second annular grooves and restricting axial movement of the pin relative to the head.

2. The tool of claim 1, wherein the handle is adapted to rotate relative to the head when the pin is disposed in the first position and the smooth portion is aligned with the handle splined aperture, and wherein rotation of the handle relative to the head is restricted when the pin is disposed in the second position and the second splined portion is engaged with the handle splined aperture.

3. The tool of claim 1, wherein the pin further includes a radially extending shoulder portion, wherein the smooth portion is disposed between the radially extending shoulder portion and the splined portion, and the radially extending shoulder portion is adapted to retain the handle on the pin.

4. The tool of claim 1, wherein the pin is selectively detained in either of the first and second positions by a detent ball and spring member.

5. The tool of claim 4, wherein the end of the handle has first and second sides, and when the pin is disposed in the first position, the detent ball is disposed proximate to the first side, and when the pin is disposed in the second position, the detent ball is disposed proximate to the second side.

6. The tool of claim 1, wherein the retaining member is a retaining ring.

7. The tool of claim 1, wherein the head includes a ratchet mechanism.

8. A connecting pin adapted to indexably couple a head of a tool to a handle of the tool, wherein the handle includes a handle splined aperture disposed proximate to an end of the handle and the end of the handle includes first and second sides, the head includes opposing first and second head ends, a drive portion is disposed proximate to the first head end, a head splined aperture is disposed proximate to the second head end, and a first annular groove extends around the head splined aperture and through splines of the head splined aperture, the connecting pin comprising:

a splined portion having first and second ends;

a smooth portion disposed proximate to the second end;

a second annular groove in the splined portion disposed between the first and second ends, wherein the splined portion meshingly engages the head splined aperture proximate to the first end and the second annular groove aligns with the first annular groove, and the second splined portion is adapted to selectively meshingly engage the handle splined aperture proximate to the second end;

a retaining member that engages the first and second annular grooves and restricts axial movement of the connecting pin relative to the head; when the retaining member is engaged with the first and second annular grooves; and a radially extending end portion disposed proximal to the smooth portion and adapted to retain the handle on the connecting pin, wherein the connecting pin is adapted to move axially with respect to the handle between first and second positions.

9. The connecting pin of claim 8 further comprising:

a bore that extends through the connecting pin in a radial direction; and a detent ball and a biasing member disposed in the aperture.

10. The connecting pin of claim 9, wherein when the connecting pin is disposed in the first position, the smooth portion is disposed in the handle splined aperture, and when the connecting pin is disposed in the second position, the splined portion is disposed in the handle splined aperture proximate to the second end.

11. The connecting pin of claim 10, wherein when the connecting pin is disposed in the first position, the detent ball is disposed proximate to the first side of the end of the handle, and when the connecting pin is disposed in the second position, the detent ball is disposed proximate to the second side of the end of the handle.

12. The connecting pin of claim 10, wherein the detent ball and the biasing member are adapted to selectively detain the handle in one of the first and second positions.

13. The connecting pin of claim 8, wherein the retaining member is a retaining ring.

* * * * *